United States Patent [19]

Hentschel

[11] Patent Number: 4,645,378

[45] Date of Patent: Feb. 24, 1987

[54] MOVABLE FORM FRONT FOR A TUNNEL-LINING FORM

[75] Inventor: Volker Hentschel, Dorsten, Fed. Rep. of Germany

[73] Assignee: Gochtief Ag Vorm. Gebr. Helfmann, Essen, Fed. Rep. of Germany

[21] Appl. No.: 717,824

[22] Filed: Mar. 29, 1985

[30] Foreign Application Priority Data

Mar. 30, 1984 [DE] Fed. Rep. of Germany ..... 3411857

[51] Int. Cl.[4] ..... E21D 9/06; E21D 11/10

[52] U.S. Cl. ..... 405/146; 277/147; 405/147

[58] Field of Search ..... 405/141, 146, 147, 150, 405/152; 277/138, 139, 147, 148, 154, 155

[56] References Cited

U.S. PATENT DOCUMENTS

| | | | |
|---|---|---|---|
| 1,296,312 | 3/1919 | O'Rourke | 405/147 |
| 1,406,684 | 2/1922 | Richards et al. | 277/147 |
| 3,768,817 | 10/1973 | Daniels | 277/148 X |
| 4,003,211 | 1/1977 | Klapdor et al. | 405/147 X |

FOREIGN PATENT DOCUMENTS

| | | | |
|---|---|---|---|
| 2702341 | 7/1978 | Fed. Rep. of Germany | 405/147 |

*Primary Examiner*—David H. Corbin

*Attorney, Agent, or Firm*—Karl F. Ross; Herbert Dubno

[57] ABSTRACT

A form front positioned between the shield of a tunnel excavator and a tunnel-lining form movable relative to both the shield and the tunnel-lining form. The form front comprises an annular support positioned with clearance space from the shield and the tunnel-lining form, wherein the annular support has a lipped inner seal pressing on the tunnel-lining form and is held thereto by pressure adjacent the inner covering surface of the annular support, and also has an outer seal held under pressure against the shield adjacent the outer covering surface of the annular support. One such form front which fulfills all the desired practical requirements comprises a circular outer seal which has a symmetrical cross section with respect to a central symmetry plane parallel to the plane of the annular support and is positioned in a circular groove provided in the annular support, and at the same time along the bottom of the circular groove under the outer seal a clamp ring divided into a plurality of clamp segments is adjustable radially with the aid of an adjusting mechanism engaged to the ends of the segments so as to tighten or loosen the form front.

12 Claims, 7 Drawing Figures

MOVABLE FORM FRONT FOR A TUNNEL-LINING FORM

CROSS REFERENCE TO RELATED APPLICATIONS

This application is related to the commonly assigned copending applications: Ser. No. 684,002 filed 20 Dec. 1984, Ser. No. 674,895 filed 26 Nov. 1984, Ser. No. 673,775 filed 21 Nov. 1984 and Ser. No. 690,163 filed 10 Jan. 1985.

FIELD OF THE INVENTION

My present invention relates to a movable form front for a tunnel-lining form which follows and is connected to a tunnel excavator or gallery head, a concrete lining or wall being formed between the tunnel-lining form and the excavator-formed tunnel wall.

BACKGROUND OF THE INVENTION

The typical form front of the prior art serves to connect the shield of a tunnel excavator to the tunnel-lining form and defines the front of the space between the lining form and the tunnel wall to be filled with concrete.

It generally comprises an annular support positioned with clearance between the shield cover and the tunnel-lining form, but having a lipped inner sealing collar between it and the tunnel-lining form and an outer sealing collar between it and a shield extension of the tunnel excavator.

In the earlier form front the outer sealing collar formed a unit with the lipped inner collar. A lipped sealing collar fulfills its function best as a sealing member spanning a gap when relative motion in only one direction occurs between the lipped seal and the surface engaged thereby. As to the lipped sealing collar engaging the tunnel-lining form this is the case because the lipped sealing collar is drawn over the stationary tunnel-lining form which generally is a translatable or movable form in only one direction. With the outer sealing collar, however, which engages the shield, relative motion of the seal and the shield does occur in both axial directions. Thus the form front can move compared to the shield but also the shield can move with respect to form front. Hence when the outer seal is formed as a lip seal, the disadvantages of leaking and loosening due to bending over of the seal can occur, and increased wear must be expected.

Of course it is also known in practice with other form fronts to install a circular sealing collar as an outer seal which has a symmetrical cross section with respect to its central symmetry plane parallel to the form front plane and is positioned in a circular groove provided in the outer covering surface of the form front. One such seal with a symmetrical profile allows relative motion in two directions opposite to each other and is made tight by its own compressibility, which assumes an installation under compression, which with the form front of the kind set forth creates problems with set up and replacement of the seal.

OBJECTS OF THE INVENTION

It is an object of my invention to provide an improved form front of the kind set forth above which fulfills all the requirements set forth and implied above.

It is also an object of my invention to provide an improved form front which serves to connect a tunnel-lining form to a tunnel excavator and in which leaking and loosening of the form front is reduced in comparison to prior art form fronts.

It is another object of this invention to provide an improved form front which serves to connect a tunnel-lining form to a tunnel excavator, in which wear due to relative motion of the shield cover of the tunnel excavator and the form front is reduced in comparison to form fronts of the prior art.

It is a further object of my invention to provide a form front between the shield cover of a tunnel excavator and a tunnel-lining form which is tightenable and loosenable under remote control so that wear due to relative motion, leaking and loosening are reduced.

SUMMARY OF THE INVENTION

These objects and others, which will become apparent hereinafter, are attained in accordance with the invention in a movable form front positioned between a shield of a tunnel excavator and a tunnel-lining form used for forming a tunnel wall or lining, wherein the form front comprises an annular support positioned with clearance between the shield and the tunnel-lining form, having a lipped inner sealing collar (inner lip seal) pressing on the tunnel-lining form and attached adjacent the inner surface of the annular support under stress or pressure, the annular support also having an outer sealing collar held adjacent the outer surface of the annular support under compression or pressure.

According to my invention, the movable form front is made adjustably tightenable by means which expands and contracts it radially, preferably under autonomous or remote control.

According to a feature of this invention a circular seal is used as the outer collar, and has a symmetrical cross section with respect to a central symmetry plane of the outer seal parallel to the plane of the annular support. The support has an outwardly open circumferential circular groove in which a tightening ring is placed. The tightening ring is divided into a plurality of segments with clearance from each other. The clamp segments are radially adjustable with the aid of a plurality of adjusting mechanisms, each of the adjusting mechanisms engaging at least one of the clamp segments.

The invention enables the insertion of a circular seal as an outer seal without problems because the outer seal in the annular support is associated with a separate press device and/or adjusting mechanism under or inwardly of the outer seal.

This pressing device and/or adjusting mechanism permits a mounting of the inner seal without applied pressure and then expansion of the outer seal and corresponding tightening of the form front under applied pressure after mounting.

Where before the outer circular seal could only be installed with increased compressibility on account of the softness of the seal which caused pressing the seal out of the circular groove, when it is drawn in a sliding motion, with the invention, the compressibility function of the circular seal is transferred to the adjusting mechanism and/or pressing device and hence the circular seal can be made harder, more compact and more wear resistant, so that it acts directly as a centering member as well.

A further advantage of the press apparatus and/or adjusting mechanism is the possibility of its remote control, which is especially welcome, since the spatial proportions very seldom permit an easy accessibility and moreover allow an immediate adjustment at the desired time.

Accordingly, further features of the invention include a detachable circular shoulder bounding the front tunnel excavator directed side of the annular groove adjacent the outer seal. This circular shoulder provides a means of retaining the seal in place during operation. Furthermore, advantageously the adjacent ends of adjacent clamp segments have adjacent inverted-L shaped recesses forming a T-shaped space between the adjacent clamp segments having a groove portion running perpendicular to the plane of the annular support and a radially running leg portion, wherein a preferably T-shaped (T-section) support plate is held in the T-shaped space, and connected to an associated adjusting mechanism. Additionally a mounting piece for attaching the adjusting mechanism can be provided on the T-shaped support plate.

Additional advantageous features of this preferred embodiment include an adjusting mechanism and/or press apparatus comprising at least one hydraulic cylinder-piston assembly inserted into a radially directed blind hole in the annular support positioned below a support plate, the free piston rod end of the hydraulic cylinder-piston assembly being attached to the associated support plate, preferably on the mounting piece.

Advantageously the cylinder of the hydraulic cylinder-piston assembly is at least partly formed by the walls of the blind hole.

The pressurized portion of the cylinder chamber of the hydraulic cylinder-piston assembly is connected to a common hydraulic line also having connected thereto a pressure gauge and a gas pressurized storage tank hydraulic pressure accumulator so that the cylinder can be pressurized to move the piston and hence to move the outer seal radially.

Preferably the piston cylinders are double acting with a hydraulic input line attached radially above and below the piston so that by applying pressure to the appropriate line the outer seal can be moved radially outwardly to tighten the form front or radially inwardly to loosen or disengage the form front. This preferred embodiment has the advantage that the form front can be made adjustably tightenable by remote control.

In another embodiment of my invention instead of a hydraulic cylinder-piston assembly the adjusting mechanism comprises an eccentric disk mounted rotatably engaging the bottom of the support plate. An eccentric disk shaft passing through the annular support is attached to a handle on the front of the annular support which, when rotated, raises and lowers the support plate and hence the seal.

In a further embodiment of my invention the adjusting mechanism comprises at least one screw which is mounted rotatably with the bolt of the screw in a radially directed threaded hole of the annular support and with a first end of the screw engaged in a circular socket in the support plate. The opposite second end of the screw has a head lying accessible from and adjacent to the inner surface of the annular support. This adjustment of the screw prior to insertion of the form front controls the tightness of the form front.

BRIEF DESCRIPTION OF THE DRAWING

The above and other objects, features and advantages of my present invention will become more readily apparent from the following description, reference being made to the accompanying highly diagrammatic drawing in which.

SPECIFIC DESCRIPTION

Figure 1:
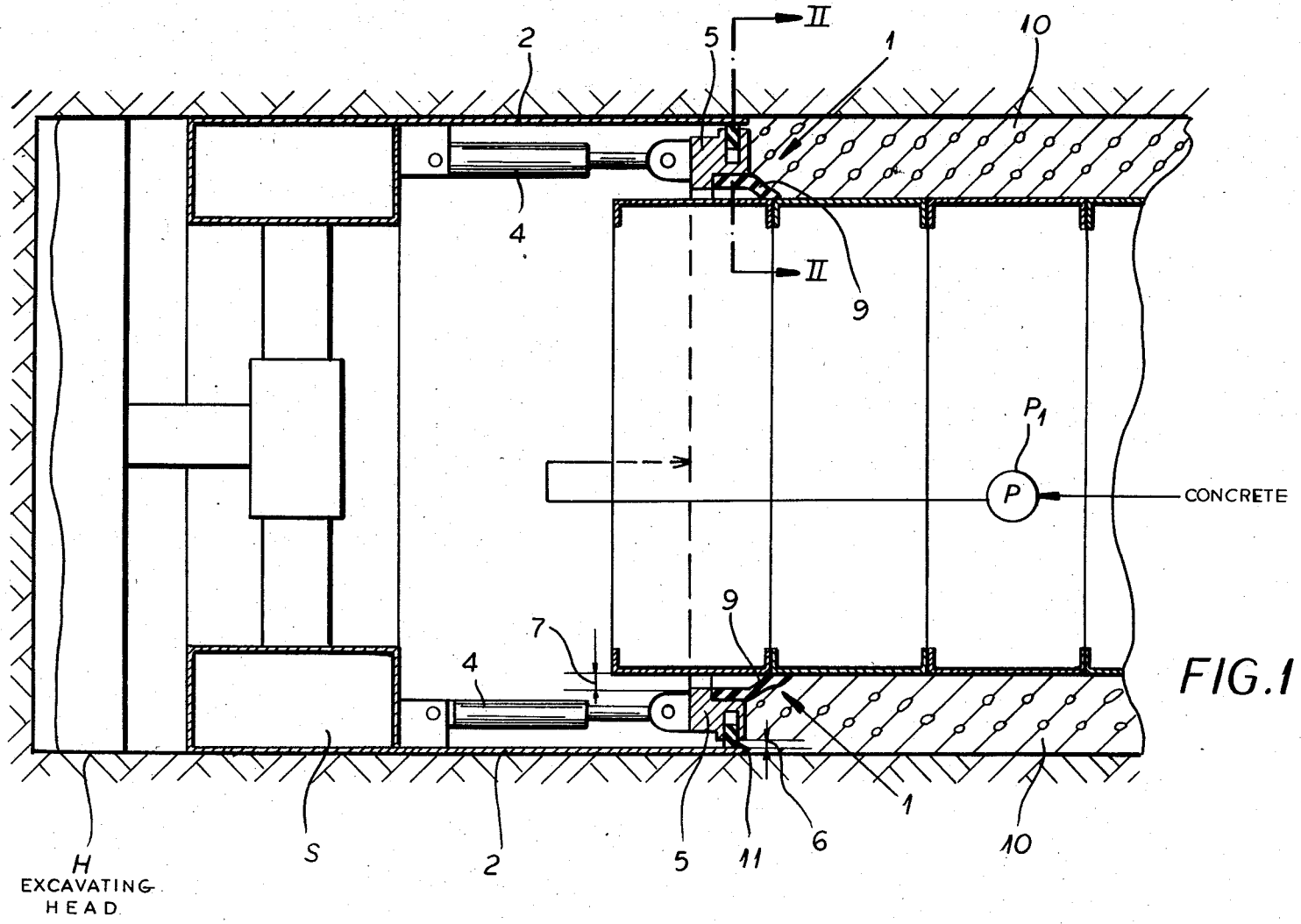
FIG. 1 is a schematic lengthwise cross sectional view through the form front of the invention with part of a tunnel excavator and associated tunnel-lining form.

The form front 1 shown in the drawing is installed between a shield extension 2 of a tunnel excavator H having a shield S and a tunnel-lining form 3 and is movable relative to the shield extension S of the tunnel excavator and the tunnel-lining form 3.

From FIG. 1 it can be seen that the form front 1 is coupled to the shield extension 2 by hydraulic cylinders 4, to allow motion of the form front 1 independent from the motion of the shield 2.

In its fundamental structure the form front 1 comprises an annular support 5, which is arranged with a first cracklike clearance space 6 between it and the shield extension 2 and a second cracklike clearance space 7 between it and the tunnel-lining form 3 constructed as a movable or translatable form (see the aforementioned applications).

On the inner surface of annular support 5 with the aid of a fastening member 8 (see also FIGS. 2 to 4) a lipped inner seal 9 is clamped under tension, so as to lie or press against the tunnel-lining form 3.

Moreover in the vicinity of the outside surface of annular support 5 an outer seal 11 is held, which lies against shield cover 2 or presses against it.

A pump P, feeds through the form front concrete into the circular space 10 between the ground and the tunnel-lining form 3 to form a tunnel wall lining.

The outer seal 11 comprises in all cases a circular bonding seal which can be assembled from a plurality of individual segments. This seal 11 has a substantially symmetrical cross section with respect to a central plane Ps of symmetry passing through it parallel to the plane of the annular support 5 and is positioned in a circular groove 12 provided in the outer surface of the annular support 5.

Along the bottom of the circular groove 12 a force distributing clamp ring divided into a plurality of clamp segments 13 is provided for and below annular or circular seal 11.

The clamp segments 13 are adjustable with the aid of an adjusting mechanism and/or press apparatus engaging their ends. It is understood that a given play is realized between the individual clamp segments 13, in order to allow the radial contraction of the clamp ring.

Figure 2:
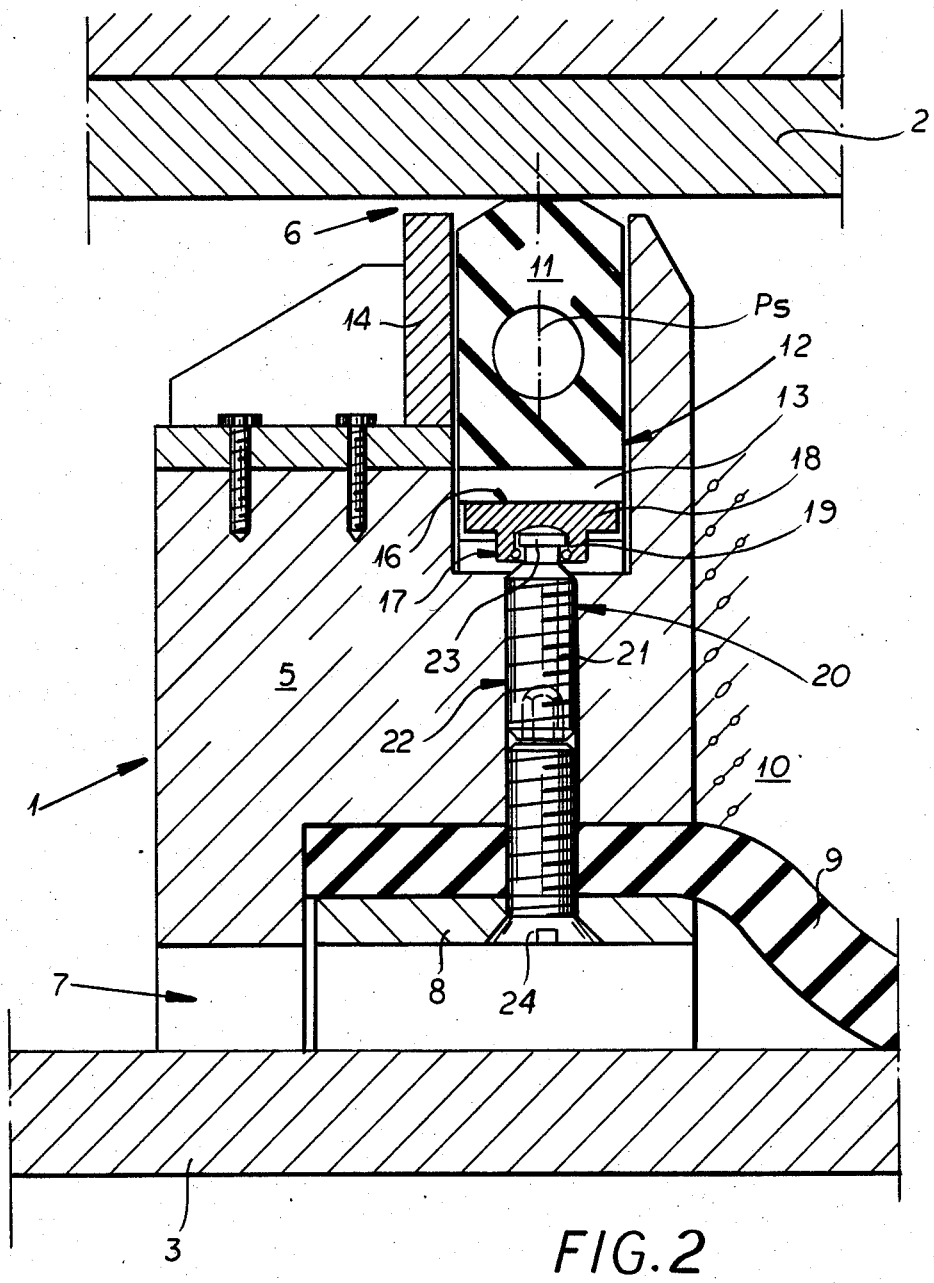
FIG. 2 is a schematic transverse cross sectional view taken along line II—II of FIG. 1 showing additional details.
Figure 3:
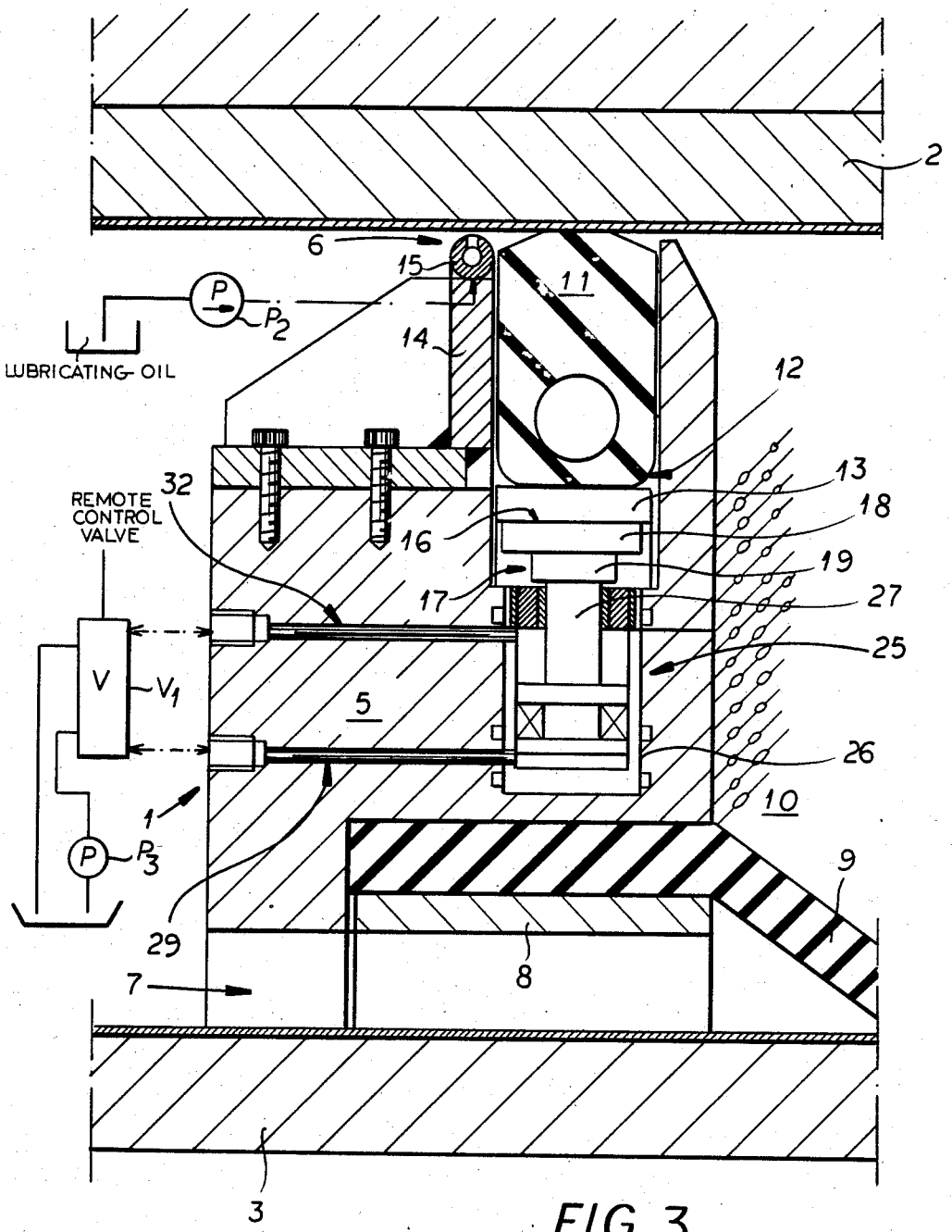
FIG. 3 is a schematic transverse cross sectional view similar to FIG. 2 according to another embodiment of my invention.
Figure 4:
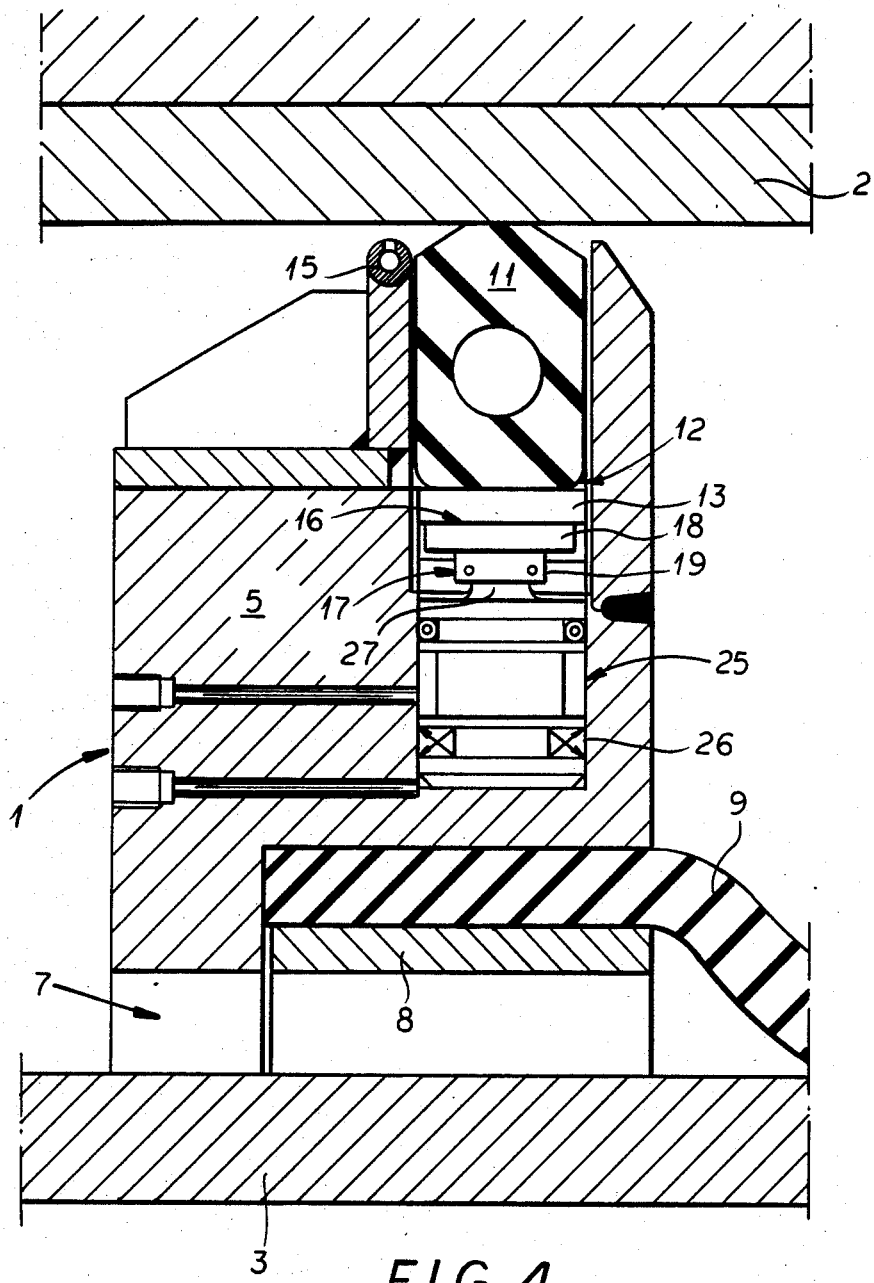
FIG. 4 is a schematic transverse cross sectional view similar to FIG. 3 with the components thereat in an altered arrangement.

From FIGS. 2 to 4 one learns further that the annular support 5 has a circular shoulder 14, which by screws is attached detachably to it and bounds the circular groove 12 in the vicinity of the outer seal 11.

After removal of this circular shoulder 14 the seal 11 can be removed or replaced from the side directed away from the concrete.

As is shown in FIGS. 3 and 4, the front ends of the circular shoulder 14 turned toward the shield cover 2 are formed with a lubricant feed pipe 15 which can be welded to flange or shoulder 14 along its periphery. A lubricant pump P2 supplies the lubricant.

Figure 7:
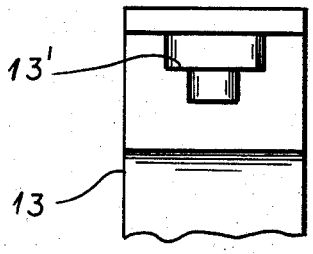
FIG. 7 is an end view of one of the pressurizing segments.

The adjacent clamp segments 13 have adjacent inverted L-section T-shaped recesses 13' (see FIG. 7) forming a T-shaped space between said adjacent clamp segments having groove portion 16 running perpendicular to the central plane Ps of the annular support 5 and connected therewith a radially directed leg portion 17. A T-shaped supporting plate 18 is by neighboring adjacent clamp segments 13 lying on the bottom of grooved portion 16 and leg portion 17. The supporting plate 18 has on its inner side directed radially inwardly a mounting piece 19 associated with an adjusting mechanism controlling form front tightness against the shield cover 2.

In the embodiment of FIG. 2 the adjusting mechanism comprises screws 20, which are rotatable (when a screw 24 is removed) with their bolts 21 in threaded holes 22 of annular support 5 and with their first free end in circular socket 23 pressing or pushing on supporting plate 18 or mounting plate 19. At its opposite end the screws 20 have hex heads receiving an Allen wrench. The threaded base is closed by a screw 24. This adjusting mechanism is placed through the lipped inner seal 9 and its fastening member 8.

Figure 6:
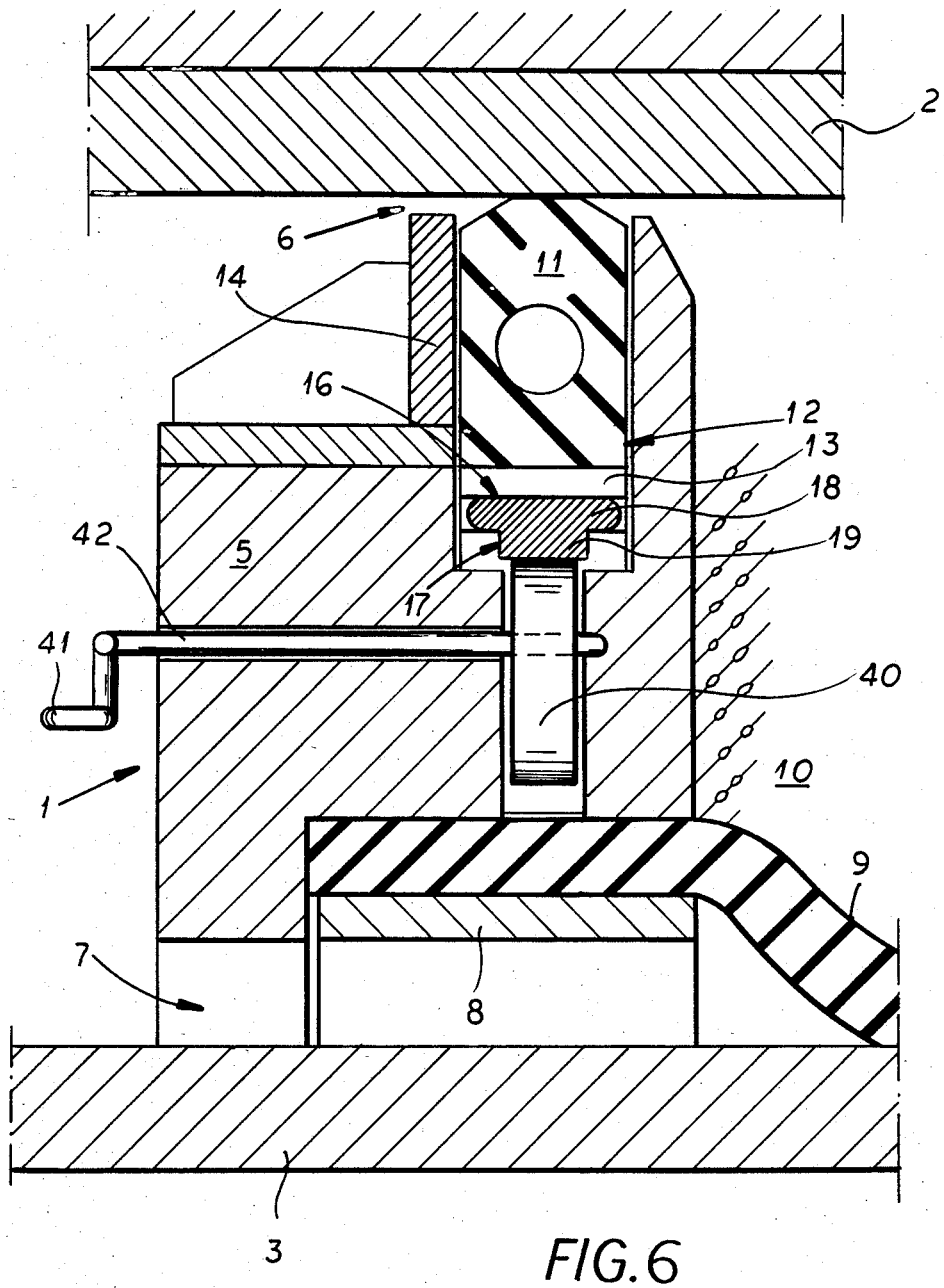
FIG. 6 is a schematic transverse cross sectional view similar to FIG. 3 according to yet another embodiment of my invention.

Instead of the screws 20, the adjusting mechanism can comprise radially mounted eccentric plate 40 rotatably supported on shaft 42 in the annular support 5 and operable from the front by handle 41. This alternative embodiment is shown in FIG. 6.

In the specific embodiment according to FIGS. 3 and 4, the preferred adjusting mechanism comprises hydraulic cylinder-piston assemblies 25, which are positioned in blind-end holes 26 of annular support 5 and the free piston rod ends 27 of that combined with associated T-shaped support plate 18 having mounting piece 19. These hydraulic piston-cylinder assemblies 25 are constructed advantageously double acting, that is, with their pistons movable either forward or away from the outer seal 11, in order to allow active adjustment of the clamp segments 13 in both the loading and unloading direction. In the specific embodiment according to FIG. 3 the hydraulic cylinder-piston assembly 25 is constructed as a separate assembly and mounted in blind-end hole 26. On the other hand in the specific embodiment according to FIG. 3 the cylinders of the hydraulic cylinder-piston assemblies 25 are formed from the walls of the blind holes 26, that is, the double acting piston of the plunger slides directly on the blind hole walls.

Figure 5:
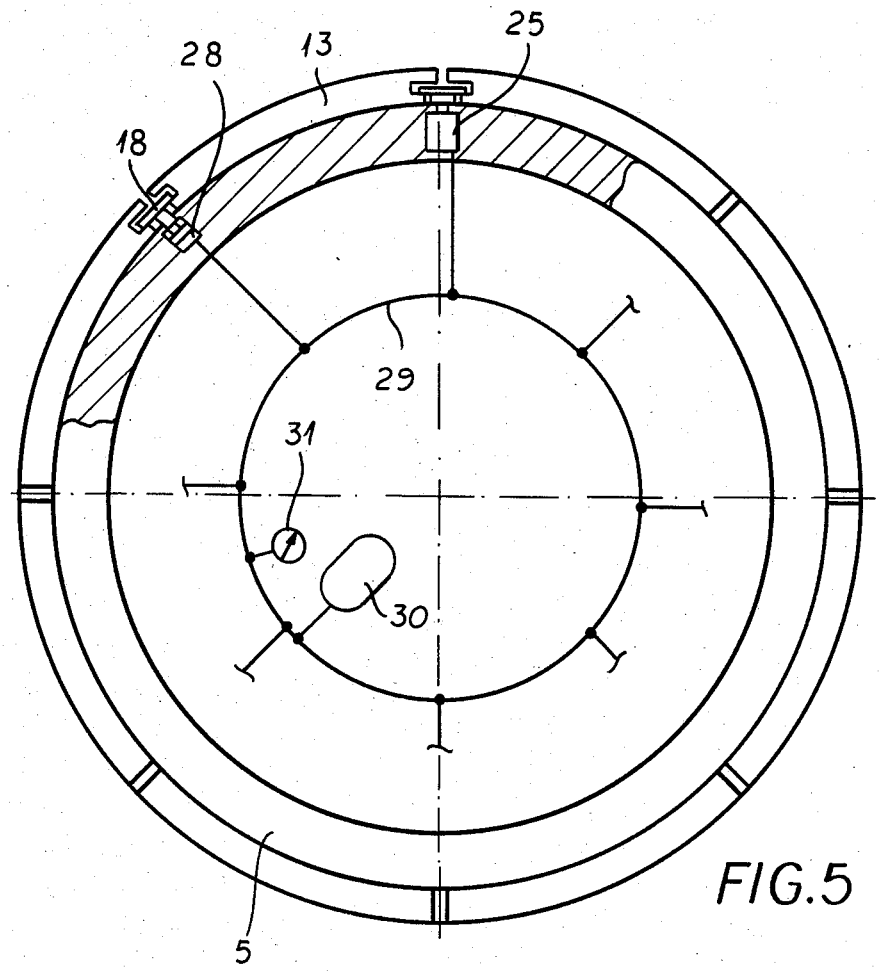
FIG. 5 is a schematic total transverse cross section through part of the form front and tunnel-lining form showing a connection arrangement.

FIG. 5 shows how the hydraulic cylinder-piston assemblies 25 are coupled with each other. The pressurized side of the hydraulic cylinder chambers 28 are connected to each other by a common hydraulic line 29. To this hydraulic line 29 a gas-pressurized hydraulic accumulator 30 and a pressure gauge 31 are connected. The latter gives by its gauge of the compression force a standing control of the tightness function and need not, as shown, be located in front.

Correspondingly the double-acting hydraulic cylinder-piston assemblies 25 can be operated from a remote location by a valve V, connected by the hydraulic line 29 and an additional hydraulic line 32 as shown in FIG. 3. The hydraulic pump for supplying the cylinders is shown at P3.

I claim:

1. In a movable form front inserted between a shield of a tunnel excavator and a tunnel-lining form used for making a tunnel wall, said form front comprising an annular support positioned with clearance between said shield and said tunnel-lining form and having a lipped inner seal pressing on said tunnel-lining form, said lipped inner seal being attached adjacent an inner surface of said annular support to said annular support under tension, said annular support also having an outer seal held adjacent an outer surface of said annular support under pressure, the improvement wherein said outer seal is a circular seal which has a symmetrical cross section with respect to a central symmetry plane parallel to a plane of said annular support and has positioned in a circumferential circular groove provided in said outer surface of said annular support a tightening ring said tightening ring being divided into a plurality of clamp segments that are arranged along a bottom of said circular groove with circumferential clearance from each other, said segments being radially adjustable with the aid of a plurality of adjusting mechanisms, each of said adjusting mechanisms engaging at least one of said clamp segments.

2. The improvement according to claim 1 wherein said annular support has connected thereto a detachable circular shoulder bounding said annular groove at least adjacent said outer seal.

3. The improvement according to claim 2 wherein the adjacent ends of adjacent ones of said clamp segments have adjacent inverted-L shaped recesses forming a T-shaped space between said adjacent clamp segments, said T-shaped space having a groove portion running perpendicular to said central plane of said annular support and a radially running leg portion, wherein a T-shaped support plate is held in said T-shaped space, said T-shaped support plate being connected with one of said adjusting mechanisms.

4. The improvement according to claim 3 wherein said support plate has a mounting piece for engaging said adjusting mechanism directed inwardly radially.

5. The improvement according to claim 4 wherein said adjusting mechanism comprises an eccentric plate rotatably mounted in said annular support engaging the bottom of said support plate, said eccentric plate being rotatable from the front side of said annular support facing said tunnel excavator to raise and lower said outer seal.

6. The improvement according to claim 4 wherein said adjusting apparatus comprises at least one screw which is mounted rotatably with the bolt of said screw in a radially directed threaded hole of said annular support and with a first end of said screw in a circular socket in said support plate.

7. The improvement according to claim 6 wherein the second end of said screw opposite to said first end has an operating head adjacent said inner surface of said annular support accessible from below radially.

8. The improvement according to claim 6 wherein said screw passes through said lipped inner seal and a fastening member securing said lipped inner seal.

9. The improvement according to claim 3 wherein said adjusting mechanism comprises at least one hydraulic cylinder-piston assembly inserted into a radially directed blind hole of said annular support, the free piston rod end of said hydraulic cylinder-piston assembly being attached to said support plate.

10. The improvement according to claim 9 wherein a cylinder of said hydraulic cylinder-piston assembly is formed at least partly by the walls of said blind hole.

11. The improvement according to claim 9 wherein a pressurized portion of the cylinder chamber of said hydraulic cylinder-piston assembly is connected to a common hydraulic line also having a gas pressure gauge and a gas storage tank attached thereto.

12. The improvement according to claim 9 wherein said hydraulic cylinder-piston assembly is constructed double-acting and by separate hydrualic lines from a direct-connected motor driven pump is regularly extendable and contractible.

* * * * *